US005558935A

United States Patent [19]

Tanaka et al.

[11] Patent Number: 5,558,935

[45] Date of Patent: Sep. 24, 1996

[54] POLYESTER FIBER AND METHOD OF MANUFACTURING THE SAME

[75] Inventors: Jun Tanaka; Fumio Himematsu, both of Nobeoka, Japan

[73] Assignee: Asahi Kasei Kogyo Kabushiki Kaisha, Osaka, Japan

[21] Appl. No.: 239,853

[22] Filed: May 9, 1994

Related U.S. Application Data

[63] Continuation of Ser. No. 983,261, Nov. 30, 1992, abandoned, which is a continuation of Ser. No. 679,665, Apr. 4, 1991, abandoned.

[30] Foreign Application Priority Data

Apr. 6, 1990 [JP] Japan ..... 2-90087
Apr. 6, 1990 [JP] Japan ..... 2-90088

[51] Int. Cl.[6] ..... D02G 3/00

[52] U.S. Cl. ..... 428/364; 428/395; 528/308.1

[58] Field of Search ..... 428/364, 395; 528/308, 308.1

[56] References Cited

U.S. PATENT DOCUMENTS

| | | | |
|---|---|---|---|
| 4,035,441 | 7/1977 | Ento et al. | 260/860 |
| 4,426,516 | 1/1984 | Kuriki et al. | 528/272 |
| 4,491,657 | 1/1985 | Saito et al. | 528/308.1 |
| 4,508,674 | 4/1985 | Kuriki et al. | 264/234 |
| 4,539,985 | 9/1985 | Ukai et al. | 57/290 |
| 4,668,264 | 5/1987 | Saton | 528/308.1 |
| 4,690,866 | 9/1987 | Kumakawa et al. | 428/364 |
| 5,108,625 | 4/1992 | Matsuo et al. | 264/103 |

FOREIGN PATENT DOCUMENTS

| | | |
|---|---|---|
| 0169415 | 1/1986 | European Pat. Off. . |
| 53-58031 | 5/1978 | Japan . |
| 57-154410 | 9/1982 | Japan . |
| 57-161119 | 10/1982 | Japan . |
| 58-98419 | 6/1983 | Japan . |
| 61-41320 | 2/1986 | Japan . |
| 62-69819 | 3/1987 | Japan . |
| 63-159518 | 7/1988 | Japan . |

OTHER PUBLICATIONS

Patent Abstracts of Japan, vol. 15, No. 206 (C–835), May 27, 1991.

Patent Abstracts of Japan, vol. 7, No. 219 (C–188), Sep. 29, 1983.

Patent Abstracts of Japan, vol. 9, No. 228 (C–303), Sep. 13, 1985.

*Primary Examiner*—Patrick J. Ryan
*Assistant Examiner*—J. M. Gray
*Attorney, Agent, or Firm*—Finnegan, Henderson, Farabow, Garrett and Dunner

[57] ABSTRACT

A polyester fiber having the following characteristics, and a method of manufacturing the same;

(a) an intrinsic viscosity of between 0.45 and 0.85, (b) $\tan\delta \leqq 0.140$ $T_{max} \leqq 130°$ C.

wherein $\tan\delta$ stands for a peak value of a dynamic loss tangent, and $T_{max}$ stands for a peak temperature, (c) $E_2/E_1 \leqq 0.49$ wherein $E_1$ stands for an elongation from zero to a secondary yield point, and $E_2$ stands for an elongation from the secondary yield point to a breaking point, (d) a stability coefficient expressed by a reciprocal value of a product of a work loss $\Delta E$ at 150° C. and a shrinkage factor under a dry heat at 175° C., of 50 or more.

A strength, a modulus of elasticity, and a resistance to fatigue of the polyester fiber in accordance with the present invention are superior, and a dimensional heat stability of this polyester fiber is remarkably improved.

10 Claims, 7 Drawing Sheets

POLYESTER FIBER AND METHOD OF MANUFACTURING THE SAME

This is a continuation of application Ser. No. 07/983,261 filed Nov. 30, 1992, now abandoned which is a continuation of application Ser. No. 07/679,665, filed Apr. 4, 1991, now abandoned.

BACKGROUND OF THE INVENTION

1. Field of the Invention

This invention relates to a polyester fiber having an extremely stable inner structure when subjected to heat. More particularly, this invention relates to a polyester fiber having a high modulus of elasticity and a high resistance to fatigue, and able to usefully serve as a fiber for reinforcing a rubber structure having a greatly improved dimensional stability when subjected to heat.

2. Description of the Related Art

It is known that a polyester fiber, particularly a polyethylene terephthalate fiber, has a high strength and a high initial modulus of elasticity and superior characteristics such as a dimensional stability, durability or the like, and accordingly, this polyester fiber is broadly used as a fiber for reinforcing rubber structures such as a V-belt, a conveyor-belt, a tire or the like. In particularly, the above-mentioned characteristics of the polyester fiber satisfy the requirements for a carcass of a radial tire of an automobile, and accordingly, the use of this polyester fiber in the radial tire of the automobile has increased.

Nevertheless, when analyzing the individual properties of the polyester fiber to be used as the fiber for reinforcing the rubber structure, the dimensional stability against heat of the polyester fiber, relative to a heat shrinkability thereof, is inferior to that of a rayon fiber, and a durability of the polyester fiber is lower than that of a polyamide fiber, and accordingly, there is a need to improve the above-mentioned properties.

In particular, when the dimensional stability against heat of the polyester fiber is made better than that of rayon, it is possible to eliminate a postcure-inflation process used for removing strain in the tire generated during the tire molding process, and accordingly, it is expected that the potential of the polyester fiber will become higher, as a fiber for reinforcing the rubber structure and having a superior cost performance than the rayon fiber and the polyamide fiber.

Japanese Unexamined Patent Publication (Kokai) No. 53-58031, No. 57-154410, No. 57-161119, No. 58-98419 or the like discloses a polyester fiber manufacturing method in which an undrawn yarn having a relatively high orientation, i.e., POY, spun from a polyester resin having a high polymerization degree by spinning under a high stress, is drawn to obtain a polyester fiber having an improved dimensional heat stability and an improved resistance to fatigue.

Nevertheless, although the polyester fiber manufactured by the above POY drawing method has an improved dimensional heat stability and improved resistance to fatigue, compared with those of an conventional polyester fiber, when comparing the rayon fiber, the dimensional heat stability of the obtained polyester fiber is still inferior to that of the rayon fiber, and the other properties of the obtained polyester fiber required as the fiber for reinforcing the rubber structure, i.e., a heat stability under an elevated temperature such as a melting point thereof, a strength, a work loss or the like, are not satisfactorily improved.

Further, Japanese Unexamined Patent publication (Kokai) No. 61-41320, No. 62-69819, No. 63-159518, No. 63-165547 or the like discloses a polyester fiber manufacturing method obtaining an undrawn yarn having a higher orientation, by increasing a stress applied to the yarn at a spinning operation and then drawing the undrawn yarn to obtain a polyester fiber having a dimensional heat stability closer to that of the rayon fiber. Nevertheless, the technique disclosed in the above publication is similar to the technique disclosed in the former publications, i.e., Japanese Unexamined Patent Publication (Kokai) No. 53-58031 or the like, in that a spinning under a high stress is attained from the polyester having a high polymerization by increasing a spinning speed and the obtained undrawn yarn is drawn, and further, in that the dimensional heat stability and the characteristics at the elevated temperature of the obtained polyester fiber are not satisfactory.

As described above, these polyester fiber manufacturing methods are characterized in that the polyester having a high polymerization degree is spun at a high spinning speed, as disclosed in the above-mentioned patent publications, to give the undrawn yarn of multifilament a higher orientation. Nevertheless, when a multifilament of the polyester having a high polymerization degree is spun at such a high speed, a cooling between single filaments constituting the multifilament is insufficient and an air current accompanying the filaments becomes larger, and thus a fusion between the single filaments and a fluctuation of the multifilament are generated. As a result, problems arise such as an increase of yarn breakages and fuzz, and that a uniformity of the thickness of the single filaments becomes very poor. When such an undrawn yarn is used, the drawability also becomes poor, and thus the strength and elongation of the obtained polyester fiber, and the processing ability thereof in a twisting process, adhesive treatment or the like, become poor.

Further, a sufficient orientation of the undrawn yarn cannot be attained due to the lowering of the spinning ability, and as a result, it is impossible to obtain any great improvement in the dimensional stability and the properties of the polyester fiber under an elevated temperature.

SUMMARY OF THE INVENTION

A first object of the present invention is to provide a polyester fiber having a high modulus of elasticity and a high resistance to fatigue, characteristics providing a melting point, a strength, a work loss or the like which are extremely stable during an elevation of a temperature, and a dimensional heat stability, such as a heat shrinkage, a shrinking stress or the like, are greatly improved and the fiber is particularly suitable as a fiber for reinforcing a rubber structure.

A second object of the present invention is to provide a method of manufacturing the polyester fiber having the above-mentioned characteristics.

In accordance with the present invention, the first object is attained by a polyester fiber comprised of an ethylene terephthalate as the main recurrent units and simultaneously satisfying the following characteristics:

(a) An intrinsic viscosity of between 0.45 and 0.85, (b) $\tan\delta \leqq 0.140$ $T_{max} \leqq 130°$ C.

wherein $\tan\delta$ stands for a peak value of a dynamic loss tangent, and $T_{max}$ stands for a peak temperature, (c) $E_2/E_1 \leqq 0.49$ wherein $E_1$ stands for an elongation from zero to a secondary yield point, and $E_2$ stands for an elongation from the secondary yield point to a breaking point, (d) A stability coefficient expressed by a reciprocal value of a product of a work loss ΔE at 150° C. and a shrinkage factor under a dry heat at 175° C. of 50 or more.

The definitions of the characteristics used in the above items (a) to (d) are given in detail hereafter.

The polyester fiber in accordance with the present invention is preferably obtained by the following manufacturing method. Namely, the second object of the present invention can be attained by a method comprised of the following steps;

(a) melt spinning a polyester having an intrinsic viscosity of between 0.50 and 0.90 at a spinning speed of at least 6.0 km/min, to obtain a undrawn yarn, (b) heat-drawing the undrawn yarn under conditions satisfying the following equations (1) to (3);

$$(2.05-12.3\ \Delta n+43.6\ \Delta n^2)\leqq DR\leqq(2.6-16.5\ \Delta n+50.0\ \Delta n^2) \quad (1)$$

$$(T_g-10)\leqq DT_1\leqq(T_g+100) \quad (2)$$

$$(T_g+100)\leqq DT_2\leqq Tm_2 \quad (3)$$

Wherein DR stands for a draw ratio, $DT_1$ stands for a drawing temperature in a former term of a drawing process, $DT_2$ stands for a drawing temperature in a latter term of the drawing process, $T_g$ stands for a glass transition temperature, Δn stands for a birefringence and $Tm_2$ stands for a crystalline melting point., (c) heat treating under a relaxed condition.

The definitions of the characteristics used in the above items (a) to (c) are given in detail hereafter.

DESCRIPTION OF THE PREFERRED EMBODIMENTS

The present invention will now be described in detail, with reference to accompanying drawings illustrating embodiments of a polyester fiber in accordance with the present invention.

An intrinsic viscosity of the polyester fiber in accordance with the present invention must be between 0.45 and 0.85, as when the intrinsic viscosity of the polyester fiber is less than 0.45, it is impossible to sufficiently increase a strength of the polyester fiber and the obtained polyester fiber is not suitable as a fiber for reinforcing a rubber structure.

When the polyester fiber having a higher intrinsic viscosity than 0.85 is obtained by melt spinning a polyester resin at a spinning speed of 6.0 Km/min or more, an inferior cooling of single filaments constituting the polyester multifilament occurs and an air current accompanying the multifilament is increased, and as a result, a fusion between single filaments and a vibration of the multifilament are generated, and yarn breakages and fuzz are increased, and further, a uniformity of the thickness of each single filament becomes very poor. Further, a sufficiently high orientation cannot be applied to the undrawn multifilament, due to the above phenomenon, and thus it is impossible to obtain the polyester fiber having greatly improved heat characteristics during an elevation of a temperature and a dimensional heat stability comparable to those of a rayon fiber.

The poor spinning ability in this case has an adverse influence on a drawing process subsequent to the spinning process, and as a result, a strength and an elongation of the obtained polyester fiber and a processing ability in a twisting process adhering process or like, becomes low. Therefore, preferably the intrinsic viscosity of the polyester fiber is between 0.50 and 0.80.

The polyester fiber in accordance with the present invention is featured by a peak value of a dynamic loss tangent, i.e., tan δ, of 0.14 or less, and a peak temperature $T_{max}$ of 130° C. or less.

Figure 1:
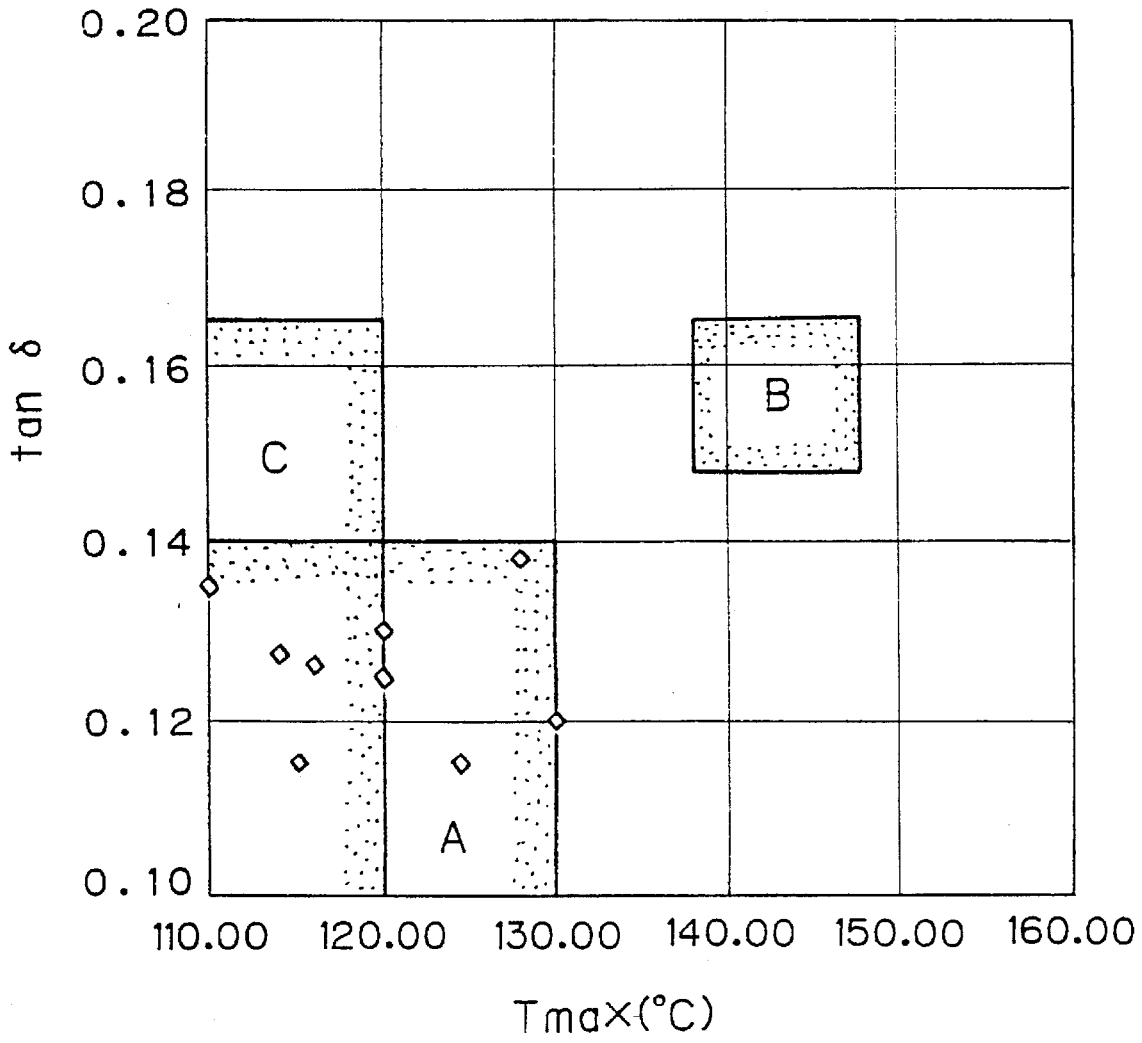
FIG. 1 is a graph showing a relationship between a peak value of a dynamic loss tangent tan δ and a peak temperature $T_{max}$ of the polyester fiber, wherein zone A is a zone of a polyester fiber in accordance with the present invention, zone B is a zone of a polyester fiber obtained by a conventional POY-drawing method, and zone C is a zone of a undrawn yarn used for manufacturing the polyester fiber in accordance with the present invention.

This feature will be described with reference to the accompanying drawing. FIG. 1 shows a relationship between the tan δ and the $T_{max}$. In the drawing, zone A is a zone showing the relationship between the tan δ and the $T_{max}$ of the polyester fiber in accordance with the present invention, and zone B is a zone showing the relationship between the tan δ and the $T_{max}$ of a polyester fiber obtained by the conventional POY-drawing method. As can be seen from FIG. 1, the values of the tan δ and the $T_{max}$ of the polyester fiber in accordance with the present invention are much lower than those of the polyester fiber obtained by the conventional POY-drawing method. The lower value of the $T_{max}$ means that, in view of a microstructure of the fiber, a relaxation of a distortion of an amorphous portion in the fiber is very high, and the lower value of the tan δ means that a good high orientation can be obtained by the drawing process. Accordingly, it is apparent that the polyester fiber in accordance with the present invention has suitable strength and elasticity modulus and has a remarkably improved resistance to fatigue and dimensional heat stability, compared to the polyester fiber obtained by the POY-drawing method.

The polyester fiber in accordance with the present invention preferably has the following features in a stress and elongation curve thereof;

(1) A stress $T_1$ at a secondary yield point of 5 g/d or more.

(2) An elongation $E_1$ at a secondary yield point of 13% or less.

(3) $E_2/E_1 \leqq 0.49$

Wherein $E_1$ stands for an elongation from zero to the secondary yield point, and $E_2$ stands for an elongation from the secondary yield point to a breaking point.

The value of $E_2/E_1$ is a remarkable characteristic value of this polyester fiber, compared with conventional polyester fibers.

Figure 2:
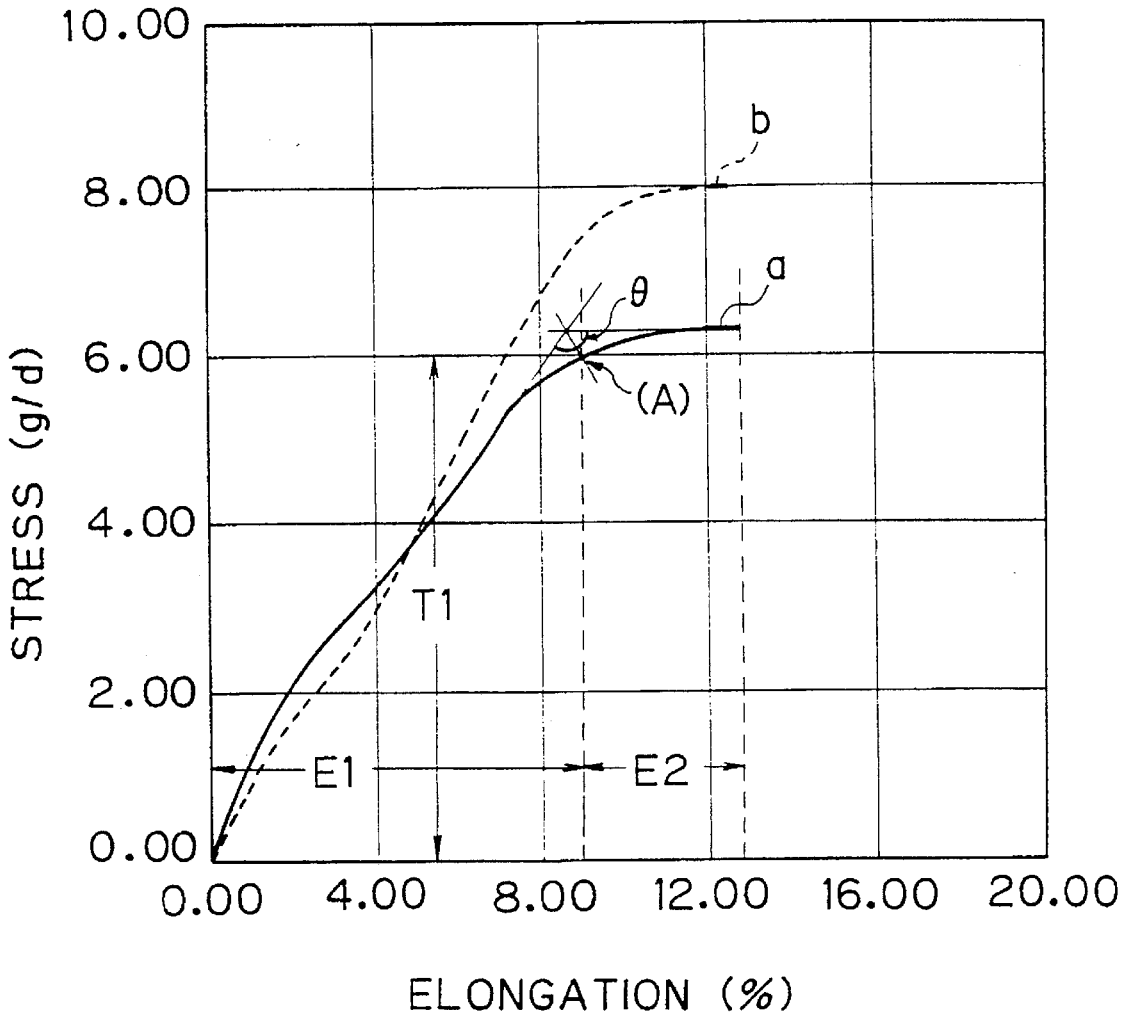
FIG. 2 shows the stress-elongation curves of polyester fibers, wherein curve a is a curve of a polyester fiber in accordance with the present invention and curve b is a curve of a polyester fiber obtained by the conventional POY-drawing method.

The above features will be described with reference to the accompanying drawing. FIG. 2 shows a stress-elongation curve of the polyester fiber, wherein curve a is a curve of the polyester fiber in accordance with the present invention and curve b is a curve of the polyester fiber obtained by the POY-drawing method.

The secondary yield point is a characteristic expressed at a point (A) in the stress-elongation curve in FIG. 2, and a value of the secondary yield point is determined by obtaining two tangent lines tangential to points of a curved line at both sides from the secondary yield point, drawing a straight line at a half angle of a angle A formed by the two tangent lines from a cross point of the two tangent lines to the stress-strain curve, and obtaining a crossing point of the straight line and the stress-strain curve.

When the elongation ratio $E_2/E_1$ of the polyester fiber is too high, a lowering of the ratio of a strength of the fiber in the rubber structure to a strength of the fiber itself is increased, and a lowering of the ratio of the strength of a cord manufactured from the polyester fiber and vulcanized under a high temperature and a high pressure also is increased, and thus the cord does not have a required toughness necessary for use as a fiber for reinforcing a rubber structure.

It is assumed that the above phenomenon is caused by an inner microfine structure of the polyester fiber in accordance with the present invention. When the $E_2/E_1$ is more than 0.49, a mean degree of orientation of each portion of the fiber, i.e., the characteristics thereof such as a mean birefringence and a degree of amorphous orientation, become lower, and a chemical stability against an adhesive, water or an amine group in the rubber structure also becomes low.

When the $E_2/E_1$ is too small, the obtained polyester fiber has an excessive orientation, and a ratio of utilization of the strength of the fiber in a twisted cord is undesirably lowered. Accordingly preferably the value of $E_2/E_1$ is between 0.10 and 0.49, more preferably between 0.20 and 0.47.

When the polyester multifilament is applied with a first twist and then with a first twist, to form a cord, and the cord is then applied with an adhesive under a high temperature while stretched, to produce a fiber for reinforcing the rubber structure, a polyester fiber having a stress $T_1$ at the secondary yield point under 5.0 g/d has an insufficient strength as a fiber for reinforcing the rubber structure, and preferably the polyester fiber has a stress at the secondary yield point of 5.5 g/d or more.

The polyester fiber having the elongation $E_1$ at the secondary yield point of over 13% cannot be sufficiently drawn and accordingly a mean degree of orientation of each portion of the fiber becomes lower, and in particular, a chemical stability against an adhesive, water or an amine group in the rubber structure become very low, and a ratio of utilization of the strength of the fiber after treating the fiber with the adhesive and vulcanizing the fiber, becomes low, and thus this fiber does not a sufficient toughness required for use as a fiber for reinforcing a rubber structure. Therefore, preferably the elongation $E_1$ at the secondary yield point is between 6% and 13%.

A coefficient of stability of the polyester fiber in accordance with the present invention, and expressed by a reciprocal value of a product of a work loss ΔE at 150° C. and a shrinkage factor under a dry heat at 175° C., is 50 or more, preferably 55 or more.

The work loss in the present application is obtained by drawing a test piece of the multifilament, at a distance of 10 inches between an upper grip and a lower grip, and at a temperature of 150° C. and a drawing speed of 0.5 inch/min, measuring a hysteresis loop of a stress between 0.05 g/d and 0.2 g/d, and expressing a hysteresis loss per 1000 denier of the fiber by an inch-pound unit. When the obtained value is low, a heat generation caused by repeated minute expansions and contractions becomes smaller, and accordingly this value is an important factor when measuring the resistance to fatigue of the fiber.

Figure 3:
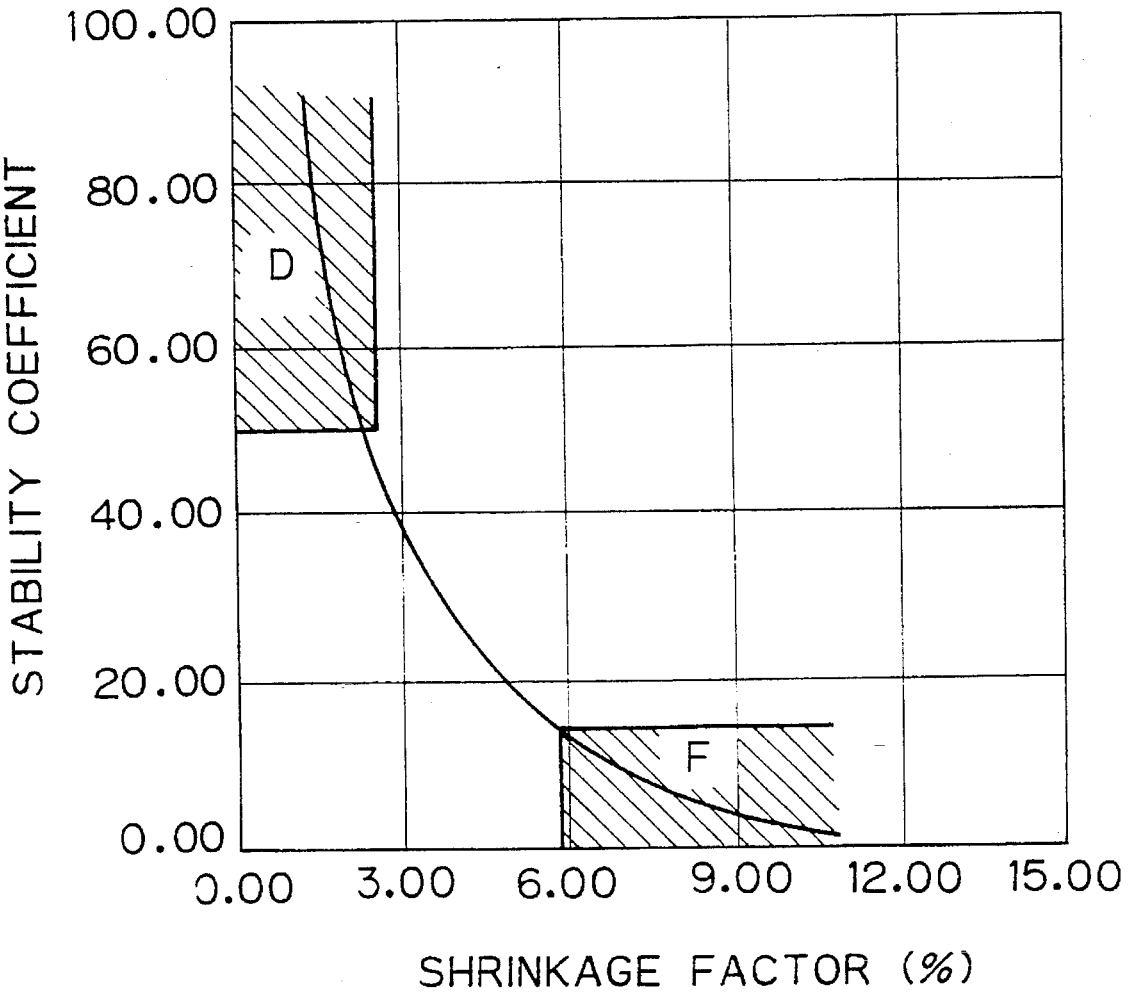
FIG. 3 is a graph showing a relationship between a shrinkage factor under a dry heat and a coefficient of stability, wherein zone D is a zone of a polyester fiber in accordance with the present invention and zone F is a zone of a polyester fiber obtained by the conventional POY-drawing method.

This feature will be described with reference to the accompanying drawing. FIG. 3 shows a relationship between a shrinkage factor under a dry heat at 175° and the coefficient of stability described above, wherein zone D is a zone showing a relationship between the shrinkage factor and the coefficient of stability of the polyester fiber in accordance with the present invention, and zone F is a zone showing a relationship between the shrinkage factor and the coefficient of stability of the polyester fiber obtained by the POY-drawing method.

As apparent from a comparison of the zone D and the zone F, in the polyester fiber in accordance with the present invention, a small shrinkage factor and a small work loss can be simultaneously attained, and the fiber is extremely stable against a change of a heat applied to the fiber, such that the coefficient of stability is over 50, and a repeated expansion and contraction. Conversely, a coefficient of stability of the conventional polyester fiber is at most 20, and it is extremely difficult to obtain a polyester fiber having a high strength, a high modulus of elasticity, and a coefficient of stability of 20 or more, desirably 45 or more, with a staple spinning and drawing process carried out by the conventional POY-drawing method as taught in, for example, Japanese Unexamined Patent Publication No. 53-58031.

The coefficient of stability of 50 or more must be maintained, to obtain a polyester fiber having a high resistance to fatigue and a greatly improved dimensional heat stability comparable to those of the rayon fiber. When the coefficient of stability is under 50, one of the dimensional heat stability or the resistance to fatigue becomes poor, and thus it is impossible to attain the high quality improved polyester fiber of the present application.

The work loss ΔE of the polyester fiber in accordance with the present invention is 0.015 or less, preferably 0.010 or less. Further, a shrinkage factor under a dry heat at 175° C. of the polyester fiber in accordance with the present invention is 2.5% or less, preferably 2.2% or less.

Preferably, the polyester fiber in accordance with the present invention has the following additional features.

A single filament cross ratio Cd of the polyester fiber in accordance with the present invention is 1.20 or less, and a uniformity of a thickness of the single filament among all the single filaments constituting a multifilament of the polyester fiber is remarkably improved, compared with that of the polyester fiber obtained by the conventional POY-drawing method. The single filament cross ratio Cd is determined by a value obtained by dividing a maximum diameter with a minimum diameter of all of the single filaments in the multifilament, and can be used as a value indicating the uniformity of the single filament in the multifilament. The single fiber cross ratio Cd is preferably 1.15 or less, more preferably 1.10 or less.

The above suitable range of the single filament cross ratio Cd can be effectively obtained in a polyester fiber having an intrinsic viscosity of between 0.45 and 0.85.

A value of TS/[η], i.e., a ratio of a strength TS of the fiber to the intrinsic viscosity [η] in the polyester fiber in accordance with the present invention, is preferably 9.0 or more, more preferably 9.5 or more. It is common knowledge to a person with ordinary skill in the art to make the intrinsic viscosity of the polyester fiber 0.90 or more, to improve the strength of the polyester fiber, but even if the polyester fiber having the intrinsic viscosity of 0.90 or more can be obtained by using the POY-drawing method or a method of spinning an undrawn yarn having a good orientation, the value of TS/[η] of the obtained polyester fiber do not reach 9.0 or more, and thus a polyester fiber having a sufficient strength cannot be obtained. This is commonly understood because a drawing ability of an undrawn yarn having a high orientation, i.e., an undrawn yarn having a high birefringence, is generally poor. Nevertheless, the inventors of the present application found that the polyester fiber in accordance with the present invention can be obtained by drawing an undrawn yarn having an extremely high orientation, and wherein the value of TS/[η] of the obtained polyester fiber is an extremely high value such as9.0 to 9.5.

The above improvement of the value of TS/[η] is obtained because the drawing operation for each single filament can be applied with an extremely uniform condition, because the single filament cross ratio of the polyester fiber in accordance with the present invention is very high, i.e., the uniformity of the multifilament of the polyester fiber is very good.

The polyester fiber in accordance with the present invention has an extremely high crystallizability, i.e., a product of a crystalline melting point $Tm_2$ and a density ρ of the polyester fiber is 370 or more, preferably 375 or more. In this case, the crystalline melting point $Tm_2$ must be 268° C. or more, preferably 269° C. or more, and the density ρ 1.398 or more, preferably 1.400 or more.

Further, preferably a melt starting temperature $Tm_1$ measured by a melting curve of DSC is 260° C. or more, more preferably 265° C. or more. Conversely, a product of a crystalline melting point $Tm_2$ and a density ρ of the polyester fiber obtained by the conventional POY drawing method is at most 369 and a melt starting temperature $Tm_1$ thereof is between 253° C. and 258° C.

When applying the above features to an extra fine structure of the polyester fiber, a crystallinity X calculated from the density ρ is 55% or more, and a crystalline size $D_c$ is 50 Å or more. This shows that the polyester fiber in accordance with the present invention is substantially can be applied with a sufficient drawing, and thus suggests that there is little lowering of dynamic characteristics such as the strength, initial modulus or the like. Accordingly the polyester fiber in accordance with the present invention has a high resistance to a high temperature treatment with a steam or a dry heat (for example, a temperature between 200° C. and 260° C.) such as a heat treatment with an adhesive and a vulcanizing treatment used for preparing a fiber for reinforcing a rubber structure, and a high resistance to a temperature applied to the fiber in the rubber structure, for example, a temperature between 100° C. and 200° C. used when making a tire or a belt.

Since the polyester fiber in accordance with the present invention has both a high crystallizability and a relaxability of a strain in an amorphous portion, the polyester fiber in accordance with the present invention has superior heat characteristics at the time of elevating the temperature, which cannot be attained in the conventional polyester fiber.

Figure 4:
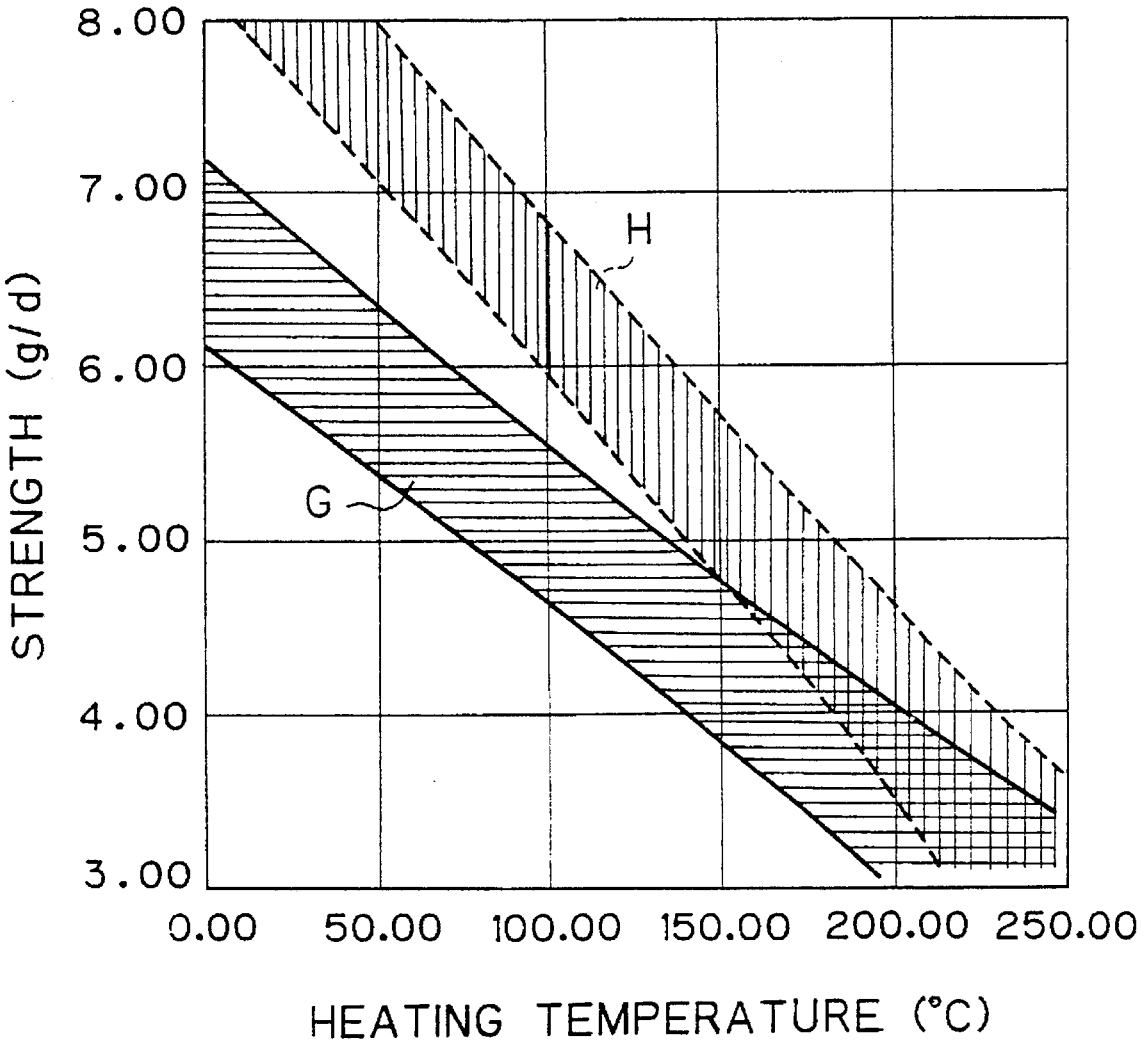
FIG. 4 is a graph showing a relationship between a heating temperature and a strength of a polyester fiber, wherein zone G is a zone of a polyester fiber in accordance with the present invention and zone H is a zone of a polyester fiber obtained by the conventional POY-drawing method.

The polyester fiber in accordance with the present invention has an extremely high resistance to heat, i.e., a temperature dependent parameter of a braking strength ΔTS/T in a range between the normal temperature and a temperature of 250° C. is preferably 0.020 g/d/° C. or less, more preferably 0.018 g/d/° C. or less, and most preferably 0.015 g/d/° C. or less. If a value of ΔTS/T is small, a lowering the ratio of the strength upon raising a temperature in an atmosphere becomes small, i.e., when the polyester fiber is accordance with the present is used as a fiber for reinforcing a rubber structure such as a tire, the polyester fiber has a high resistance to an elevation of the temperature during a running of the tire. This feature will be described with reference to an accompanying drawing. FIG. 4 shows a change of a strength of the polyester fiber upon elevating a temperature applied to the polyester fiber, wherein zone G is a zone of a polyester fiber in accordance with the present invention and zone H is a zone of a polyester fiber obtained by the conventional POY-drawing method. As is apparent from a comparison of zone G and zone H, the polyester fiber in accordance with the present invention has a much lower temperature dependency of a braking strength.

Figure 5:
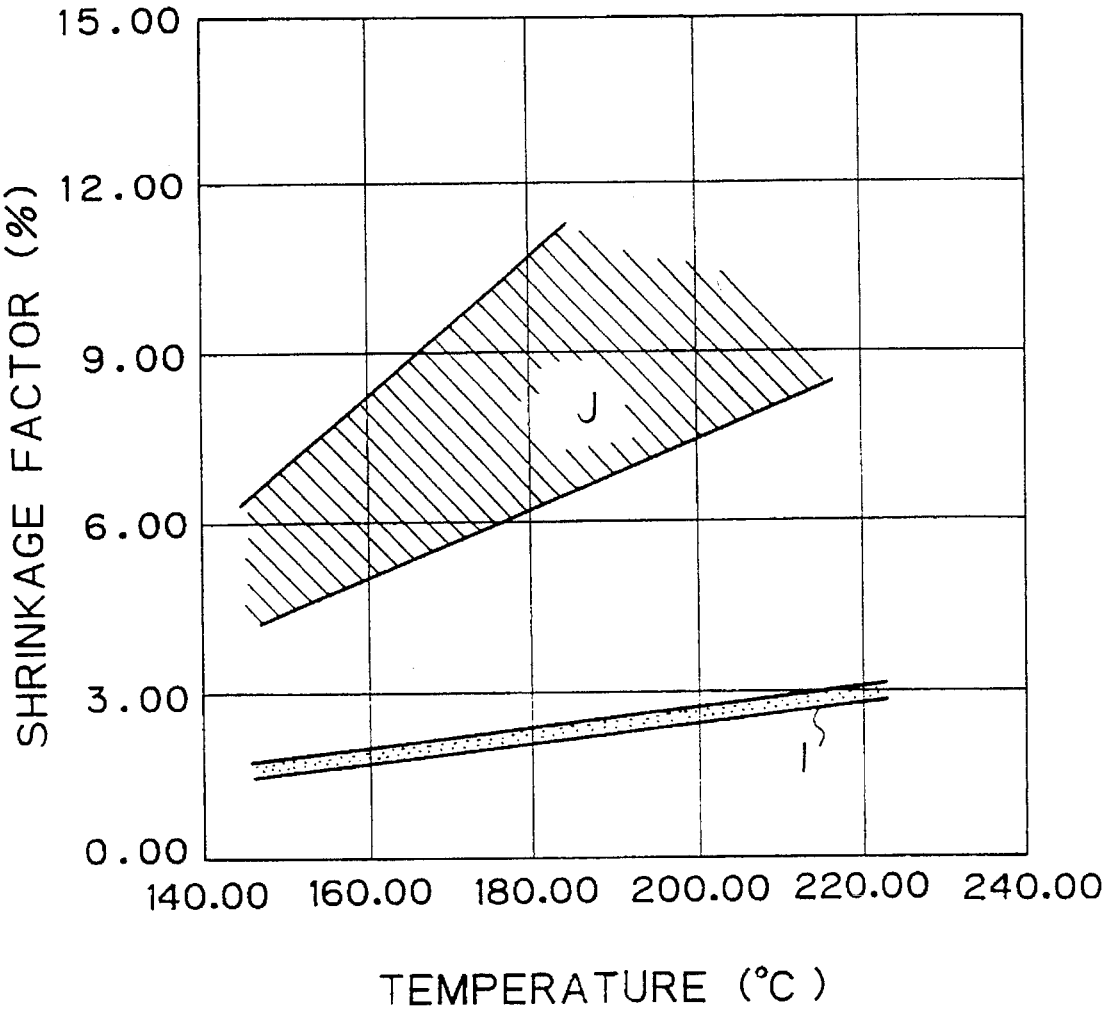
FIG. 5 is a graph showing a relationship between a heating temperature and a shrinkage factor of a polyester fiber, wherein zone I is a zone of a polyester fiber in accordance with the present invention and zone J is a zone of a polyester fiber obtained by the conventional POY-drawing method.

A temperature dependent parameter of a shrinkage factor ΔHS/T expressed as a change of a shrinkage under a dry heat during an elevating of a temperature is preferably 0.040%/° C. or less. This feature will be explained with reference to an accompany drawing. FIG. 5 shows a shrinkage factor under a dry heat of the polyester fiber at several temperatures, wherein zone I is a zone of a polyester fiber in accordance with the present invention, and zone J is a zone of a polyester fiber obtained by the POY-drawing method. As apparent from a comparison of zone I and zone J, the polyester fiber in accordance with the present invention has a lower shrinkage factor under the dry heat and an far lower change of the shrinkage factor depending on a heating temperature. The lower value of ΔHS/T means that a change of a dimensional heat stability when raising a temperature in an atmosphere is minute, and as a result, a processability of the polyester fiber when a rubber structure is manufactured from the polyester fiber in the same way as for fibers for reinforcing the rubber structure, becomes uniform and staple. For example, a change of a strain of the polyester fiber in a vulcanizing process is small.

A value of ΔHS/T is preferably 0 025%/° C., more preferably 0.017%/° C.

A curve of a shrinking stress under heat of the polyester fiber in accordance with the present invention shows that the shrinking stress under heat is substantially absent at 200° C., and a peak of the shrinking stress under heat of 0.10 g/d appears in a zone of a temperature of 255° C. or more.

The heat shrinking stress and the heat shrinkage factor are factors used to determine the dimensional heat stability of the fiber. Namely, when a fiber having a large heat shrinkage factor and heat shrinking stress is used as a reinforcing fiber for, for example, a rubber tire, the rubber tire is vulcanized, and while vulcanized rubber tire is kept stationary, the vulcanized rubber tire is deformed by the heat shrinking stress to an irregular shape and the size of the rubber tires is reduced. Accordingly it is necessary to apply an additional process, i.e., a postcure inflation in which the vulcanized rubber tire is kept in a state such that a pressure is applied to an inside of the tire so that the vulcanized rubber tire cannot shrink and then the tire is cooled.

Figure 6:
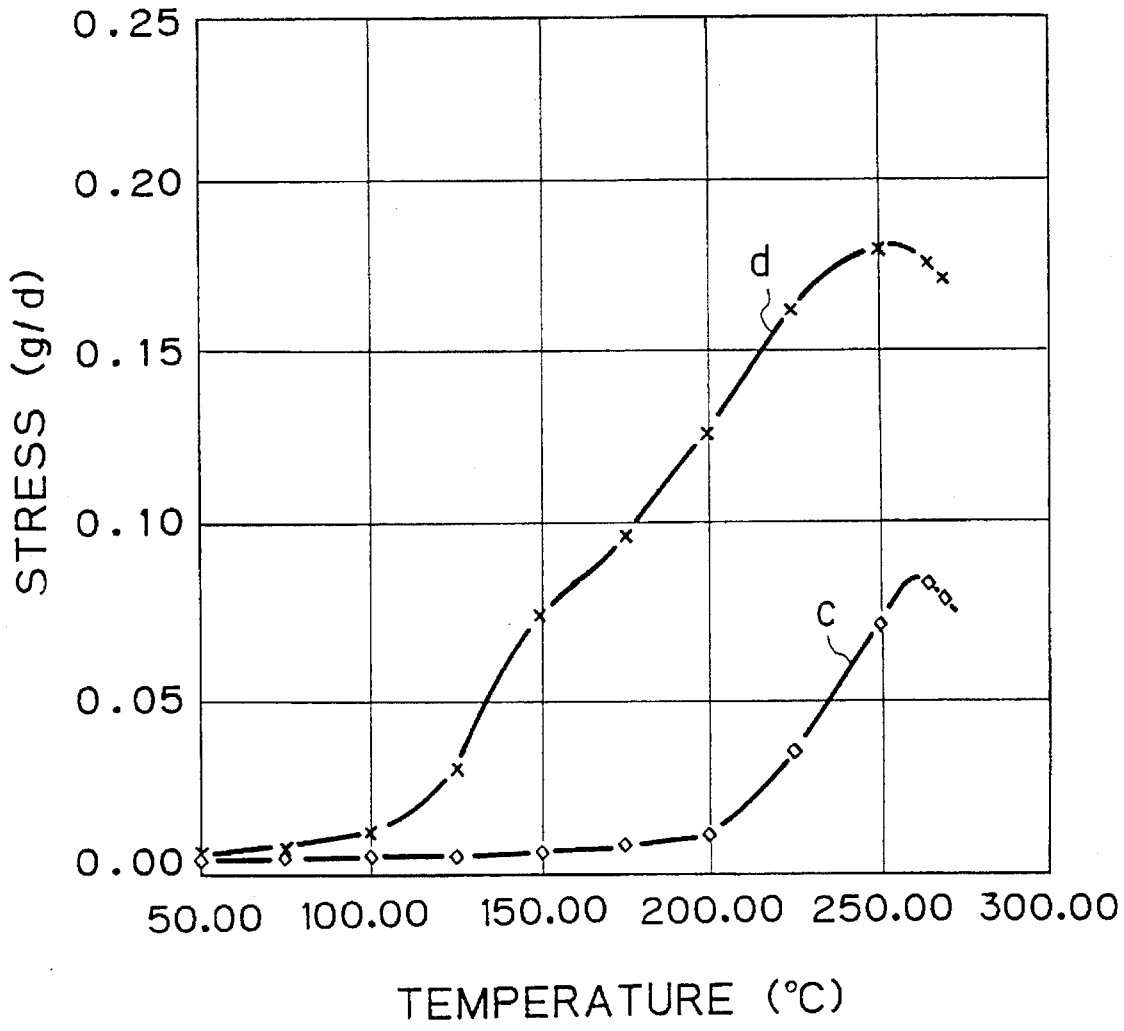
FIG. 6 is a curve showing a relationship between a temperature and a shrinking stress under heating wherein curve c is a curve of a polyester fiber in accordance with the present invention and curve d is a curve of a polyester fiber obtained by the conventional POY-drawing method; and, FIG. 7 is a graph showing a relationship between a spinning speed and a birefringence of a fiber wherein zone K is a zone of an undrawn yarn of a polyester fiber in accordance with the present invention and zone L is a zone of an undrawn yarn of a polyester fiber obtained by the conventional POY-drawing method.

As described above, the polyester fiber in accordance with the present invention has a remarkable small shrinkage factor compared with the conventional polyester fiber, and the dimensional heat stability thereof is also remarkably improved. This will be described in detail with reference to the drawings. FIG. 6 is a temperature to heat shrinking stress curve obtained by plotting the heat shrinking stress at several temperatures. The curve c is a curve of a polyester fiber in accordance with the present invention and a curve d is a curve of a polyester fiber obtained by the conventional POY-drawing method.

As can be seen from a comparison of curve c and curve d, a shrinking stress of the polyester fiber c is substantially constant at 200° C., and the polyester fiber c has a peak of 0.10 g/d or less at a temperature of 255° C. or more. Conversely, the heat shrinking stress of the polyester obtained by the POY-drawing method becomes larger from around 100° C., and in particular, the heat shrinking stress increases suddenly at around 100° C., and this polyester fiber has a peak of 0.17 g/d or less at a temperature of 250° C. or less. Accordingly, the features of the temperature to heat shrinking stress curve of the polyester fiber in accordance with the present invention are completely different from those of the conventional polyester fibers.

The heat shrinking stress upto 200° C. of the polyester fiber in accordance with the present invention is preferably 0.02 g/d or less, more preferably 0.015 g/d or less, and there is substantially no increase of the heat shrinking stress upto 200° C.

A method of manufacturing a polyester fiber in accordance with the present invention will be described hereafter.

A polyester fiber in accordance with the present invention can be obtained by melt spinning a polyester having an intrinsic viscosity of between 0.50 and 0.90, preferably between 0.55 and 0.85, and comprised of an ethylene terephthalate as main recurrent units, at a spinning speed of at least 6.0 km/min to obtain an undrawn yarn, and then heat-drawing the undrawn yarn.

In the polyester of the present invention, the recurrent unit of 85 mol % or more in the polyester is constituted by the ethylene terephthalate, and the polyethylene terephthalate manufactured from a terephthalic acid or a functional derivative thereof, and an ethylene glycol is mainly used.

Nevertheless, a polyester in which a part of the terephthalic acid or the functional derivative which is an acid component of the polyethylene terephthalate is replaced with at least one compound selected from a group of a bifunctional acid or a functional derivative thereof such as an isophthalic acid, an adipic acid, a sabacic acid, an azelaic acid, a naphthol acid, a P-oxibenzoic acid, 2.5-dimethyl terephthalic acid or the like at a content of less than 15 mol %, or in which a part of the ethylene glycol, which is a glycol component of the polyethylene terephthalate, is replaced with at least compound selected from a group of a dihydric alcohol such as a diethylene glycol, a 1–4 butadial or the like at a content of less than 15 mol %, may be used as a copolymer. Further the polyesters may be added with an antioxidant, a fire retardant, an adhesion improving agent, a matting agent, a colorant or the like.

A content of an end carboxyl group of the polyester used in the present invention may be 30 equivalent amount/$10^6$ g or less, preferably 20 equivalent amount/$10^6$ g or less, more preferably 15 equivalent amount/$10^6$ g or less. If necessary a hindering agent capable of hindering the end carboxyl group, such as an epoxy compound, a carbonate compound, a carbodiimide or the like, can be added to an extruder to make a blended material. A content of the end carboxyl in the thus-obtained polyester is 25 equivalent amount/$10^6$ g or less, preferably 15 equivalent amount/$10^6$ g or less, more preferably 10 equivalent amount/$10^6$ g or less.

The polyester fiber in accordance with the present invention can be obtained by melt spinning a polyester having an ethylene terephthalate as a main recurrent unit by a conventional screw-type extruder. A temperature of a polymer just after the extrusion is 310° C. or less. A diameter of holes of a spinneret may be between 0.2 mm and 0.7 mm, and preferably a plurality of holes are arranged in a one to five ring-like arrangement. Further, preferably a thickness of a single filament is 3 d/f to 10 d/f.

A yarn extruded from the spinneret is immediately passed through a heating zone having a length of 5 cm or more and a temperature of an inside atmosphere thereof between 150° C. and 350° C. Next the yarn is passed through a cooling apparatus in which the yarn is cooled by applying cool air from an outer circumference of the yarn, to provide a cooled solid yarn.

It is very important to suitably select the extruding condition and the cooling condition to obtain a polyester fiber having a good uniformity, in particular to obtain a polyester fiber having a lower single fiber cross ratio.

The cooled solid yarn is applied with a predetermined quantity of an oil, by using an oil-feeding nozzle as a fiber collecting guide, and the yarn is then wound as an undrawn yarn at a speed, i.e., a spinning speed, of 6.0 km/min or more preferably between 6.0 km/min and 8.0 km/min.

The features of the thus obtained undrawn yarn, and a relationship between the undrawn yarn and the polyester fiber in accordance with the present invention, will be described in detail hereafter.

As described above, the peak value tan δ of the dynamic loss tangent of the polyester fiber in accordance with the present invention is 0.140 or less, and the peak temperature $T_{max}$ thereof is 130° or less. To obtain the above polyester fiber, the tan δ of the undrawn yarn must be 0.165 or less and the $T_{max}$ thereof must be 120° C. or less. That is, the values of tan δ and $T_{max}$ of the polyester fiber are changed by a drawing process and a heat treatment process, and thus the polyester fiber having the above-mentioned features can be obtained only by drawing and heat processing the undrawn yarn having the above-mentioned features relating to a microstructure thereof.

This feature will be described with reference to an accompanying drawing. A zone C in FIG. 1 is a zone illustrating a relationship of the tan δ and $T_{max}$ of the undrawn yarn in the present invention. As can be seen from FIG. 1, the zone C of the tan δ and $T_{max}$ of the undrawn yarn moves to the zone A of the tan δ and $T_{max}$ of the polyester fiber in accordance with the present invention.

A birefringence Δn of the undrawn yarn of the present invention satisfies the following equation $$(0.058\ V-0.004\ V^2-0.105) \leqq \Delta n \leqq (0.058\ V-0.004\ V^2-0.059) \quad (4)$$

wherein V stands for a spinning speed (km/min).

The birefringence of the undrawn yarn shows a degree of orientation of the fiber, and has a great influence on the formation of a microstructure of the drawn and heat treated polyester fiber and a dimensional heat stability and resistance to fatigue of the polyester fiber depends greatly on the value of the birefringence of the undrawn fiber.

Figure 7:
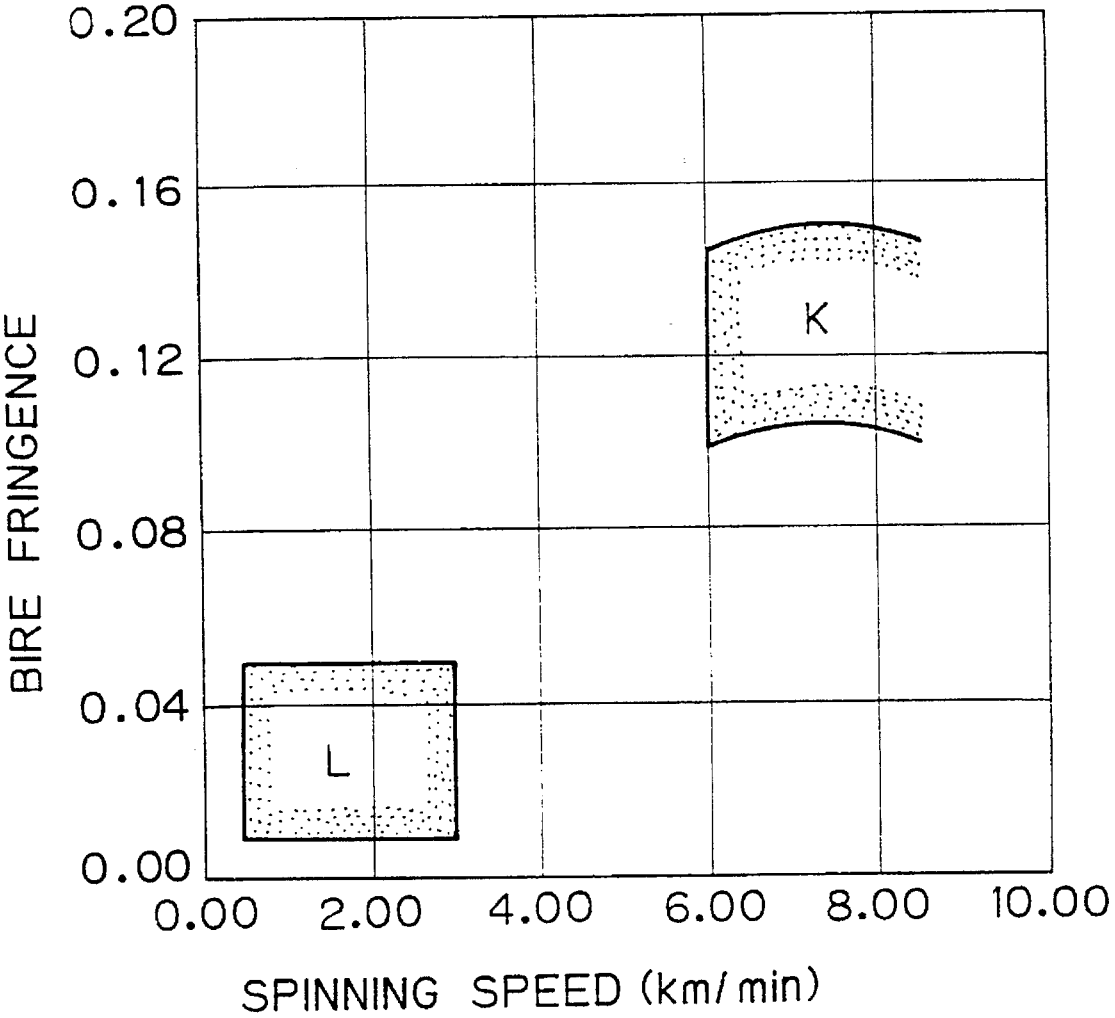

A relationship of a spinning speed and characteristics of the undrawn yarn will be described with reference to an accompanying drawing. FIG. 7 is a graph showing a relationship between the spinning speed and the birefringence of the undrawn yarn of the polyester fiber, wherein zone K is a zone relating to the polyester fiber in accordance with the present invention and zone L is a zone relating to the polyester fiber obtained by the conventional POY-drawn method. The undrawn yarn of the polyester fiber in accordance with the present invention has a high value of the birefringence in relation to the spinning speed and this value appears to be a maximum value thereof, and thus the undrawn yarn having such an extremely higher orientation is used for manufacturing the polyester fiber in accordance with the present invention.

A birefringence of the undrawn yarn of the polyester fiber in accordance with the present invention is 0.099 or more, preferably 0.110 or more, more preferably 0.120 or more.

A birefringence $\Delta n_c$ of a crystalline phase of the undrawn yarn of the polyester fiber in accordance with the present invention is 0.190 or more, and a crystallinity $X_c(\%)$ obtained by a wide angle X-ray diffraction thereof satisfies the following equation.

$$X_c \geqq (1337\ \Delta n_c - 202) \quad (5)$$

A value of the birefringence $\Delta n_c$ of the crystalline phase shows an orientation of the crystalline portion of a fiber, and the undrawn yarn in accordance with the present invention has a high crystallizability and a high crystalline orientation.

Since the birefringence of the crystalline phase and the crystallinity of the undrawn yarn are simultaneously kept at a high value, a strength, density, and melting point of the crystalline of the polyester fiber obtained by drawing and heat-treating the undrawn yarn can be made high values, and as a result, when the polyester fiber in accordance with the present invention is used as a fiber for reinforcing the rubber structure, a high toughness and a high modulus of elasticity, and an improved resistance to heat of the rubber structure can be obtained.

The birefringence $\Delta n_c$ of the crystalline phase of the undrawn yarn of the polyester fiber in accordance with the present invention is 0.190 or more as described herebefore, preferably 0.195 or more. The crystallinity of this undrawn yarn is 52% or more, preferably 60% or more, more preferably 65% or more.

A drawing process and a heat treating process used in the manufacture of the polyester fiber in accordance with the present invention will be described hereafter.

The undrawn yarn is drawn to make a polyester fiber. The undrawn yarn may be directly drawn from a spinning process to a drawing process, or the undrawn yarn wound on a yarn package such as a cheese and the undrawn yarn then unwound from the yarn package and fed to the drawing process. The drawing operation of the undrawn yarn may be made in one stage or in multistages, such as two stages or more. When the drawing process is performed by using the yarn package, the winding speed of a drawn fiber may be optimally determined, but preferably the winding speed is between 500 and 3,000 m/min, in consideration of a stability of the drawing process and productivity of the polyester fiber.

A drawing ratio DR and a drawing temperature DT in the drawing process are extremely important factors when determining fundamental physical characteristics such as a toughness, a modulus of elasticity a deterioration by vulcanization, and a dimensional stability or the like.

The drawing ratio DR may be determined in a range expressed in the following equation, according to the value of the birefringence $\Delta n$ of the undrawn yarn.

$$(2.00-12.3\ \Delta n+43.6\ \Delta n^2) \leqq DR \leqq (2.6-16.5\ \Delta n+50.0\ \Delta n^2) \quad (1)$$

It was realized that there is generally a correlation between the birefringence of the undrawn yarn and the drawing ratio, but since the drawing operation at an extremely high spinning e.g. 6.0 Km/min or more, as in the present invention generally has problems, a relationship between the birefringence of the undrawn yarn obtained by the spinning process of 6.0 Km/min or more and the drawing ratio has not been clarified herebefore.

After studying the drawing process of the undrawn yarn having an extremely high birefringence, the present inventors found that a process not causing fuzz or yarn breakages, and having characteristics such as a toughness, modulus of elasticity stability against chemical substances, and dimensional heat stability can be obtained by using a process condition satisfying the above equation (1).

When the drawing ratio DR is outside the range determined by the equation (1) for the predetermined birefringence of the undrawn yarn, fuzz and many yarn breakages are generated, and a utilization of the strength of the polyester fiber in a twisted yarn and the dimensional heat stability lowered. When the drawing ratio DR is less than the value determined by the equation (1), the toughness of becomes poor and the stability against chemical substances is lowered. When the drawing process is kept in the conditions satisfying the equation (1), the drawing ratio $E_2/E_1$ can be kept in the suitable range described herebefore, and the polyester fiber having a high toughness and the high modulus of elasticity, a superior resistance to chemical substances, and superior dimensional heat stability can be obtained. An actual drawing ratio to be suitably used depends on the birefringence of the undrawn yarn, but when a spinning speed of 7.0 Km/min is used, the suitable drawing ratio is between 1.05 and 1.55, preferably between 1.10 and 1.40, more preferably between 1.20 and 1.30.

It is preferable to use a drawing temperature determined in the following equations (2) and (3)

$$(Tg-10) \leqq DT_1 \leqq (Tg+100) \quad (2)$$

$$(Tg+100) \leqq DT_1 \leqq (Tm_2) \quad (3)$$

wherein $DT_1$ stands for a drawing temperature in a former stage of the drawing process, $DT_2$ stands for a drawing temperature in a later stage of the drawing process, and Tg stands for a glass transition point.

It is apparent that the drawing temperature determines the fundamental feature of the polyester fiber with the drawing ratio.

It is preferable to successively apply a heat treatment to a drawn fiber under a relaxed condition, of between 0.9 and 1.0, preferably between 0.95 and 1.0, at a temperature of between 180° C. and 260° C. In this heat treating process, a strain caused by a stress applied during the process of manufacturing the polyester fiber is uniformly relaxed and a final crystallinity and orientation can be determined.

The birefringence of the polyester obtained by drawing the undrawn yarn in accordance with the above method becomes a value of between 0.150 and 0.180.

The polyester fiber obtained by the above method in accordance with the present invention have a good uniformity as a single filament, a high modulus of elasticity and a high resistance to fatigue, and further, has a superior dimensional heat stability similar to that of a viscous rayon.

EXAMPLES

The present invention will be further explained by way of examples, which is no way limit the invention. The definition and measurements of various characteristics, as used throughout this specification, are as follows.

Stress-strain curve

This measurement is based on JISL-1017-1983(7.5), and uses a Shimazu Autograph SS-100.

A measurement of a parameter of a temperature dependency of a breaking strength is performed by gripping a test piece of a fiber in a furnace at a predetermined temperature, and drawing the test piece in the Shimazu Autograph.

Inherent Viscosity [η]

A reduction viscosity $\eta_{sp/c}$ of a solution in which a 1 g sample is dissolved in 100 ml of ortho-chlorophenol is measured by using an Ostwald viscometer in a temperature controlled bath having a temperature of 35° C., and an intrinsic viscosity is calculated by the following equation $$\eta_{sp/c}=[\eta]+0.277\,[\eta]^2$$

End Carboxyl Group

This measurement is based on the POHL method described in Anal. Chem. 26, 1616 (1957)

Shrinkage Factor under Dry Heat HS

This measurement is based on JIS-1017-1983 (7.10.2)

Work Loss ΔE at 150° C.

A hysteresis loop of a sample is measured under the following conditions

Sample length: 10 inch

Rate of Pulling: 0.5 inch/min

Temperature: 150° C.

Stress applied to the sample: between 0.6 g/d and 0.05 g/d

A hysteresis loss per 1000 d is calculated and expressed by a unit of the inch.pound unit system. (refer to Japanese Unexamined Patent Publication No. 3-58031)

Shrinking Stress Under Heat

The measurement is performed by using a THERMAL STRESS TESTER supplied from Kanebo Engineering Co., under the following conditions.

Initial load: 0.01 g/d

Temperature Elevate Rate: 100° C./min

Birefringence Δn

The measurement is performed by using a polar optical microscope supplied from Olympus Kougaku Co., on the basis of a retardation method using a Berek Compensator, under the following conditions.

Light Source: Na-D Line

Immersion Liquid: α-bromonaphthalene/Olive oil

Cross Ratio Cd of Single Filament

A diameter of all single filaments constituting a multifilament is measured on the bases of a cross sectional microphotograph, and the cross ratio Cd is expressed as a ratio between a mean maximum diameter and a mean minimum diameter thereof.

Dynamic Loss Tangent Tanδ and Peak Temperature $T_{max}$

The tanδ values at each temperature are measured by a using Rheo-Vibron DDV-II type dynamic viscoelasticity tester supplied from TOYO Baldwin Co., under the following conditions.

Sample Weight: 0.1 mg

Frequency: 110 Hz

Temperature Elevation Rate: 5° C./min

A peak value in the obtained tanδ values is defined as the tanδ used in the present invention, and $T_{max}$ is defined as a temperature corresponding to the tanδ value.

Density ρ

The measurement is performed by using a gradient tube density determination adjusted by carbon tetrachloride/n-hepthane at a temperature of 25° C.

Crystalline Melting Point $Tm_2$ and Melt Starting point $Tm_1$

A melting curve is measured by using DSC-4 type tester supplied from Perkin Elmer, under the following conditions.

Sample Weight: 4.0 mg

Temperature Elevation Rate: 20° C./min

A peak temperature of the obtained melting curve is defined as $Tm_2$.

A temperature at a cross point between a line tangential to a lower temperature side of the melting carve and a base line is defined as $Tm_1$.

Crystallinity X according to Density Method

The crystallinity X is calculated from the measured density on the basis of the following equation.

$$X=\{\rho c(\rho-\rho a)/\rho(\rho c-\rho a)\}\times 100$$

wherein ρ stands for the measured density ρc is 1.455 g/cm$^3$, and ρa is 1.335 g/cm$^3$.

Crystalline Size $D_c$

An X-ray generator, type RU-200PL supplied from Rigaku Electric Company, having a Cu-Kα line light source and a wave length λ of 1.5418 Å, and made monochromatic by a nickel filter is used.

$D_c$ is obtained from a half value width in an intensity distribution curve obtained by scanning at an equatorial line (010) and (100) in a wide angle X-ray diffraction on the basis of the following equation (Scherrer) as a mean value.

$$D_c=K\lambda/\beta\cdot\cos\theta$$

wherein

β stands for a half value width (radian),

θ stands for an angle of diffraction (°) K is 1

λ stands for a wavelength of a X ray (1.5418 Å)

Crystallinity $X_c$ measured by a Wide Angle X-Ray Diffraction.

$X_c$ is obtained by dividing an area of the wide angle X-ray diffraction intensity distribution curve used in the measurement of $D_c$ to a crystalline portion and an amorphous portion, and calculating an area ratio on the basis of the following equation.

$$X_c=\frac{\text{Scattering intensity in the crystalline portion}}{\text{Total Scattering Intensity}}\times 100$$

Birefringence in Crystalline Phase Δnc

Δnc is obtained from a product of a degree of orientation fc and a birefringence Δncm of a perfect crystal body; 0.213 is used as Δncm. A value of fc is obtained from a half value width $H^0$ of an intensity distribution curve measured along a Debye-scherrer ring on an equatorial line (010) and (100) in the wide angle X-ray diffraction, on the basis of the following equation.

$$F_c=(180-H)/180$$

Properties of Treated Cord (1) Intermediate Elongation KE

This value is expressed as an elongation of the treated cord corresponding to a stress of 6.75 kg.

(2) Utilization Ratio of Strength of Raw Yarn to strength of Treated Cord

This value is expressed as a percentage of a strength of a raw yarn, i.e. a drawn yarn, to a strength of a undrawn yarn.

(3) Dimensional Stability

This value is expressed as a sum of the shrinkage factor under dry heat HS at 150° C. and the intermediate elongation KE (4) Utilization Ratio of Strength of Raw Yarn to Strength of Treated Cord This value is expressed as a percentage of a strength of two raw yarns, i.e. two drawn yarns, to a strength of a vulcanized cord. A sample of the vulcanized cord is prepared by pulling out the cord from a vulcanized rubber structure. The vulcanizing process conditions are as follows.

Temperature: 153° C.

Pressure: 60 kg/cm$^2$

Treating time: 60 min (5) Utilization Ratio of Strength of Raw Yarn to Strength of Cord subjected to Fatigue Test This value is expressed as a percentage of a strength of two raw yarns, i.e., two drawn yarns, to a strength of a cord subjected to a fatigue test. The cord is subjected to the fatigue test according to the Disk method based on JIS L-1017-1693 (1.3.2.2), for 72 hours, and the strength of the treated cord is measured.

(6) Exotherm Temperature of Tube

A tube fatigue test according to Good year A method based on JIS L-1017-1963 (1.3.2.1) is applied to a rubber structure for 100 minutes, and then a temperature of a surface of the rubber structure is measured by a non-contact type thermometer.

EXAMPLES 1 TO 9

Chips of a polyethylene terephthalate having an intrinsic viscosity [η] of between 0.55 and 0.85 are melt spun by a screw type extruder. In this process, N,N'-bis(2,6-di-isopropyl)phenylcarbodiimide is added to the polyethylene terephthalate in such a manner that a concentration of an end carboxyl group becomes between 8 eq/10$^6$ g and 10 eq/10$^6$ g.

The temperatures of the polymers are kept under 305° C. as shown in Table 1, and a spinnerate in which a plurality of holes having a diameter of 0.35 mm are concentrically arranged is used.

A yarn extruded from the spinnerate is passed through a heating zone having a length of 100 mm and a temperature on an inside surface of which of 300° C., and a cooling air having a temperature of 20° C. and a relative humidity of 80% is applied from a circumference of the yarn onto the yarn, to cool the yarn and make the yarn a solid. The obtained yarn is applied with oil by passing the yarn through an oiling nozzle, and wound at a speed of between 6.0 Km/min and 8.0 Km/min onto a yarn package of the undrawn yarn.

Next, a plurality of undrawn yarns are fed in a gathered state to an drawing machine comprising a taking up roller, a first drawing roller, a second drawing roller, a relaxation roller and a winder, and subjected to a drawing operation and a heat treating process at a winding speed of 1500 m/min to have polyester fiber of 1500 denier/255 filaments.

The manufacturing conditions of each example and characteristics of the undrawn yarn are shown as examples No. 1 to No. 9 in Table 1, and the characteristics of the drawn yarn are shown as examples No. 1 to No. 9 in Table 2.

A drawing ratio DR1 in Table 1 is a ratio of a circumferential speed of the first drawing roller to a circumferential speed of the taking up roller, a drawing ratio DR2 in Table 1 is a ratio of a circumferential speed of the second drawing roller to the circumferential speed of the first drawing roller. The term R is a ratio of a circumferential speed of a relaxation roller to the circumferential speed of the second drawing roller. The mark FR is The taking up roller, the mark 1GD is the first drawing roller, the mark 2GD is the second drawing roller, and the mark RR is the relaxation roller.

The evaluation of a spinning state and a drawing state is performed by marking a circle O or a cross X, considering a generation of fuzz and yarn breakages, and observing the fuzz appearing on the yarn.

The drawing yarns of the polyester fibers in the examples 1 to 9 have a superior uniformity of a single filament ($C_d$), and a micro fine structure having an extremely high crystallizability, in which a strain in an amorphous portion thereof is remarkably relaxed. The thermal characteristics under an elevated temperature such as a melting point, strength, work loss or the like of the drawn yarns of the polyester fibers in examples 1 to 9, is extremely stable, and a dimensional heat stability such as a shrinkage under heat, a stress under heat or the like thereof is greatly improved. That is the drawn yarns in Examples 1 to 9 satisfy all of the requirement of the present invention.

COMPARATIVE EXAMPLE 1

A drawn yarn in the comparative Example 1 is manufactured under the same conditions as used in Example 2, except that a spinning speed of 3.0 Km/min and a drawing ratio of 2.52 are used.

The other manufacturing conditions and characteristics of the drawn yarn in the Comparative Example 1 are shown in Tables 1 and 2. As can be seen from Tables 1 and 2, the obtained polyester fibers do not satisfy the requirements of the present invention, such as the crystallizability, i.e., $Tm_1$, $Tm_2$, $Tm_{2xp}$, X and $D_c$, Δn, the parameter in the amorphous portion, i.e., tanδ and $T_{max}$, the thermal characteristics under an elevated temperature, i.e., ΔE, a coefficient of stability and ΔTs/T, and the dimensional heat stability, i.e., a shrinkability under heat and a shrinking stress under heat.

COMPARATIVE EXAMPLE 2

A drawn yarn in the Comparative Example 2 is manufactured under the same conditions as used in the Example 2, except that a spinning speed of 3.0 Km/min, a temperature of a polymer of 310° C., an intrinsic viscosity of a chip of 0.95 and a drawing ratio of 2.35 are used.

The other manufacturing conditions and characteristics of the drawn yarn in the Comparative Example 2 are shown in Tables 1 and 2. As can be seen from Tables 1 and 2, a uniformity of the single filament, i.e. a cross ratio and a ratio of a strength to an intrinsic viscosity Ts/[η] of the drawn yarn, in Comparative Example 2 are not sufficient, and this drawn yarn does not satisfy the requirements of the present invention, such as the crystallizability, i.e., $Tm_1$, $Tm_2$, $Tm_{2xp}$, X and $D_c$ , Δn, the parameter in the amorphous portion, i.e., tanδ and $T_{max}$, the thermal characteristics under an elevated temperature, i.e., ΔE, a coefficient of stability and ΔTs/T, and the dimensional heat stability, i.e., a shrinkability under heat and a shrinking stress under heat.

COMPARATIVE EXAMPLE 3

A drawn yarn in the Comparative Example 3 is manufactured under the same conditions as used in Example 2, except that a spinning speed of 4.5 Km/min and a drawing ratio of 1.68 are used.

The other manufacturing conditions and characteristics of the drawn yarn in the Comparative Example 3 are shown in Tables 1 and 2. As can be seen from Tables 1 and 2, the obtained polyester fibers do not satisfy the requirements of the present invention, such as the crystallizability, i.e., $Tm_1$, $Tm_2$, $Tm_{2xp}$, X and $D_c$ , Δn, the parameter in the amorphous portion, i.e., tanδ and $T_{max}$, the thermal characteristics under an elevated temperature, i.e., ΔE, a coefficient of stability and ΔHS/T, and the dimensional heat stability, i.e., a shrinkability under heat and a shrinking stress under heat.

COMPARATIVE EXAMPLE 4

A drawn yarn in the Comparative Example 4 is manufactured under the same conditions as used in the Example 2, except that an intrinsic viscosity of a chip of 0.95, a temperature of a polymer of 310° C., and a drawing ratio of 1.19 are used.

The other manufacturing conditions and characteristics of the drawing yarn in the Comparative Example 4 are shown in Tables 1 and 2. In this Comparative Example 4, a fusion between the single filaments and a fluctuation of the yarn are generated, and as a result, many yarn breakage occur and fuzz is generated. Such yarn breakages and fuzz are also generated in a drawing and heat treating process.

As can be seen from Tables 1 and 2, the drawn yarn of the Comparative Example 4 does not satisfy the requirements of the present invention, such as the crystallizability, i.e., $Tm_1$, $Tm_2$, $Tm_{2xp}$, X and $D_c$, Δn, the parameter in the amorphous portion, i.e., tanδ and $T_{max}$, the thermal characteristics under an elevated temperature, i.e., ΔE, a coefficient of stability and ΔHS/T, and the dimensional heat stability, i.e., a shrinkability under heat and a shrinking stress under heat.

COMPARATIVE EXAMPLE 5

A drawn yarn in the Comparative Example 5 is manufactured under the same conditions as used in the Example 2, except that a much larger drawing ratio, i.e., 1.35, compared to that used in the present invention is used.

In this Comparative Example 5, yarn breakages and fuzz are generate in a drawing and heat treating process, and the elongation and the value of $E_2/E_1$ of the drawn yarn of the polyester fiber in this Comparative Example 5 are too small, and therefore, a utilization ratio of a strength of the drawn yarn in a cord prepared by the drawn yarn becomes remarkably lower and the strength of the cord is remarkably lower.

COMPARATIVE EXAMPLE 6

A drawn yarn in the Comparative Example 6 is manufactured under the same conditions as used in Example 2, except that an extremely lower drawing ratio, i.e., 1.19, than that used in the present invention are used.

The value of $E_2/E_1$ of the drawn yarn of the polyester fiber in this Comparative Example 6 is too large, and therefore, a strength of a cord prepared by the drawn yarn becomes lower and, a utilization ratio of the strength of the drawn yarn in a vulcanized cord is undesirably lower.

COMPARATIVE EXAMPLE 7

A drawn yarn in the Comparative Example 7 is manufactured under the same conditions as used in Example 2, except that an intrinsic viscosity of a chip of 0 40, a temperature of a polymer of 290° C. and a drawing ratio of 1.24 are used.

Yarn breakages and fuzz are greatly generated in a drawing and heat treating process, and undesirably, the value of $T_1$ and the strength of the drawn yarn of the polyester fiber become lower.

EXAMPLES 11 TO 19 AND COMPARATIVE EXAMPLES 11 TO 17

The drawn yarns obtained in the Examples 1 to 9 and the Comparative Examples 1 to 7 are applied with a first twist of 400 T/m having a Z direction, by a twister, and then the obtained twisted yarn is further applied with a final twist of 400 T/m having an S direction, to make a cord. The cord is applied with an adhesive having as main component thereof resorcin, formalin and a rubber latex, and then applied with a heat treatment to produce a treated cord. In the heat treatment, a dry heat treatment at 160° C. for 90 sec under a condition that the cord is kept at a constant length, a dry heat treatment at 240° C. for 120 sec under a condition that the cord is stretched, and a dry heat treatment at 240° C. for 40 sec under a condition that the cord is relaxed, are sequentially applied to the cord. A stretch ratio and a relaxation ratio are determined in such a manner that an elongation of the cord under a stress of 6.75 kg becomes between 3.5% and 4.0% according to the characteristics of the drawn yarn used.

The characteristics of the treated cords in Examples 11 to 19 and Comparative Examples 11 to 17 are shown in Table 3. The treated cords in Examples 11 to 19 and Comparative Examples 11 to 17 are manufactured from the drawn yarn in an example or a Comparative Example having a number lower 10 than a number of the example or the Comparative Example, respectively.

The treated cords in Examples 11 to 19 have superior characteristics such as a high strength at an elevated temperature, a low exotherm temperature of a tube, a high resistance to fatigue, a low heat shrinkage factor, and a superior dimensional stability. Namely these treated cords have a superior dimensional heat stability.

On the contrary, in the treated cords in the Comparative Examples 11 to 13, the strength at an elevated temperature is lower, and an exotherm temperature of a tube, a resistance to fatigue, a shrinkage factor under heat, and a dimensional heat stability are poor.

The treated cord in Comparative Example 14 has a lower strength, and a strength at an elevated temperature, an exotherm temperature of a tube, a resistance to fatigue, a shrinkage factor under heat of this treated cord and a dimensional stability under heat are poor.

The treated cord in Comparative Example 15 has a lower utilization ratio of a strength of the drawn yarn to a strength of the cord, and a lower strength of the cord. The treated cord in Comparative Example 16 has a lower strength of the cord and a lower utilization ratio of a strength of the drawn yarn to a strength of a vulcanized cord. The treated cord in Comparative Example 17 has a lower utilization ratio of a strength of the drawn yarn to a strength of the cord and a lower strength of the cord.

As described above, the polyester fiber in accordance with the present invention has an extremely high crystallizability and a greatly improved relaxation of a strain in an amorphous portion, and therefore, in the polyester fiber in accordance with the present invention, thermal characteristics such as a melting point, strength, work loss or the like are extremely stable at an elevated temperature, and dimensional characteristics under heat such as a thermal shrinkage, a shrinking stress under heat or the like are greatly improved. Namely, when the polyester fiber in accordance with the present invention is used as a fiber for reinforcing a rubber structure, the polyester fiber in accordance with the present has the following superior characteristics.

1. Any lowering of the strength at an elevated temperature and an initial modulus is small.
2. The work loss is small, and accordingly, an exothermic heat generated by the work loss becomes small.
3. A creep ratio of the fiber at an elevated temperature is small.
4. A shrinkage factor under heat is small Accordingly, the polyester fiber in accordance with the present invention has superior thermal characteristics at an elevated temperature and a dimensional heat stability which are substantially equal to those of the rayon fiber.

TABLE 1

Conditons for Spinning and Drawing Process and Characteristics of Undrawn Yarn

| Numbers of Examples and Comparative Examples | Conditions for Spinning and Drawing Process | | | | | | | | | | | Status | |
|---|---|---|---|---|---|---|---|---|---|---|---|---|---|
| | Spinning Speed (Km/min) | Polymer Temperature [°C.] | Viscosity of Polymer [η] | Drawing Ratio DR1 | DR2 | R | Total DR | Temperature in Drawing and Heat Treatment Process FR | 1GD | 2GD | RR | Spinning | Drawing |
| Example | | | | | | | | | | | | | |
| 1 | 6.0 | 295 | 0.65 | 1.15 | 1.145 | 0.98 | 1.29 | 80° C. | 160° C. | 240° C. | 240° C. | ○ | ○ |
| 2 | 7.0 | 295 | 0.65 | 1.15 | 1.127 | 0.98 | 1.27 | 80° C. | 160° C. | 240° C. | 240° C. | ○ | ○ |
| 3 | 8.0 | 295 | 0.65 | 1.15 | 1.109 | 0.98 | 1.25 | 80° C. | 160° C. | 240° C. | 240° C. | ○ | ○ |
| 4 | 7.0 | 300 | 0.75 | 1.15 | 1.127 | 0.98 | 1.27 | 80° C. | 160° C. | 240° C. | 240° C. | ○ | ○ |
| 5 | 7.0 | 305 | 0.85 | 1.15 | 1.141 | 0.98 | 1.29 | 80° C. | 160° C. | 240° C. | 240° C. | ○ | ○ |
| 6 | 7.0 | 295 | 0.55 | 1.15 | 1.109 | 0.98 | 1.25 | 80° C. | 160° C. | 240° C. | 240° C. | ○ | ○ |
| 7 | 7.0 | 292 | 0.53 | 1.15 | 1.109 | 0.98 | 1.25 | 80° C. | 160° C. | 240° C. | 240° C. | ○ | ○ |
| 8 | 7.0 | 295 | 0.65 | 1.15 | 1.109 | 0.98 | 1.25 | 80° C. | 160° C. | 240° C. | 240° C. | ○ | ○ |
| 9 | 7.0 | 295 | 0.65 | 1.15 | 1.136 | 0.98 | 1.28 | 80° C. | 160° C. | 240° C. | 240° C. | ○ | ○ |
| Comparative Example | | | | | | | | | | | | | |
| 1 | *3.0 | 295 | 0.65 | 1.70 | 1.513 | 0.98 | 2.52 | 80° C. | 160° C. | 240° C. | 240° C. | ○ | ○ |
| 2 | *3.0 | 310 | *0.95 | 1.70 | 1.411 | 0.98 | 2.35 | 80° C. | 160° C. | 240° C. | 240° C. | ○ | ○ |
| 3 | *4.5 | 295 | 0.65 | 1.30 | 1.319 | 0.98 | 1.68 | 80° C. | 160° C. | 240° C. | 240° C. | ○ | ○ |
| 4 | 7.0 | 310 | *0.95 | 1.15 | 1.056 | 0.98 | 1.19 | 80° C. | 160° C. | 240° C. | 240° C. | *x | *x |
| 5 | 7.0 | 295 | 0.65 | 1.15 | 1.198 | 0.98 | *1.35 | 80° C. | 160° C. | 240° C. | 240° C. | ○ | *x |
| 6 | 7.0 | 295 | 0.65 | 1.15 | 1.064 | 0.98 | *1.19 | 80° C. | 160° C. | 240° C. | 240° C. | ○ | ○ |
| 7 | 7.0 | 290 | 0.40 | 1.15 | 1.100 | 0.98 | 1.24 | 80° C. | 160° C. | 240° C. | 240° C. | *x | *x |

| Numbers of Examples and Comparative Examples | Crystallizability | | | | | | |
|---|---|---|---|---|---|---|---|
| | Δn (–) | Strength (g/d) | Elongation (%) | tan δ (–) | $T_{max}$ (°C.) | Δnc (–) | $X_c$ (%) |
| Example | | | | | | | |
| 1 | 0.120 | 4.65 | 45.0 | 0.160 | 117 | 0.195 | 63 |
| 2 | 0.125 | 4.70 | 43.5 | 0.145 | 110 | 0.196 | 65 |
| 3 | 0.126 | 4.80 | 40.5 | 0.130 | 105 | 0.199 | 69 |
| 4 | 0.135 | 4.75 | 43.7 | 0.139 | 108 | 0.197 | 67 |
| 5 | 0.134 | 4.96 | 44.5 | 0.142 | 109 | 0.197 | 68 |
| 6 | 0.120 | 4.65 | 40.6 | 0.150 | 116 | 0.195 | 65 |
| 7 | 0.125 | 4.60 | 41.5 | 0.148 | 114 | 0.197 | 67 |
| 8 | 0.125 | 4.71 | 43.1 | 0.142 | 112 | 0.197 | 65 |
| 9 | 0.130 | 4.73 | 42.1 | 0.145 | 109 | 0.196 | 66 |

TABLE 1-continued

Conditons for Spinning and Drawing Process and Characteristics of Undrawn Yarn

| Comparative Example | | | | | | | |
|---|---|---|---|---|---|---|---|
| 1 | *0.035 | 2.40 | 185.0 | *0.440 | 108 | * | * |
| 2 | *0.040 | 2.45 | 165.0 | *0.400 | 112 | * | * |
| 3 | *0.080 | 3.65 | 90.0 | *0.250 | 110 | *0.175 | *40 |
| 4 | *0.090 | 4.51 | 34.9 | *0.167 | *125 | *0.185 | *51 |
| 5 | 0.125 | 4.71 | 43.1 | 0.142 | 112 | 0.197 | 65 |
| 6 | 0.120 | 4.73 | 42.1 | 0.145 | 109 | 0.196 | 66 |
| 7 | 0.125 | 3.01 | 38.0 | 0.145 | 114 | 0.199 | 69 |

Note: the mark * in Table shows items outside range determined by the present invention or shows unsuitable state.

TABLE 2

Characteristics of Drawn Yarn

| Numbers of Examples and Comparative Examples | [η] (–) | [COOH] (eq/t) | Single Filament Cd (–) | Strength, Elongation and Initial Modulus: Strength (g/d) | Elongation (%) | Initial Modulus (g/d) | TS/[η] (–) | ΔTS/T (g/d/°C.) | T1 (g/d) | Curve: E1 (%) | E2 (%) | E2/E1 (–) | Crystallizability: $Tm_1$ (°C.) | $Tm_2$ (°C.) |
|---|---|---|---|---|---|---|---|---|---|---|---|---|---|---|
| Example | | | | | | | | | | | | | | |
| 1 | 0.63 | 10.2 | 1.03 | 6.5 | 12.8 | 124 | 10.3 | 0.019 | 5.8 | 9.3 | 3.5 | 0.38 | 260 | 269 |
| 2 | 0.62 | 10.5 | 1.07 | 6.3 | 12.7 | 126 | 10.2 | 0.015 | 6.0 | 9.1 | 3.6 | 0.40 | 266 | 269 |
| 3 | 0.63 | 9.5 | 1.04 | 5.9 | 12.8 | 124 | 9.4 | 0.012 | 5.8 | 9.0 | 3.8 | 0.42 | 268 | 270 |
| 4 | 0.72 | 10.5 | 1.12 | 6.6 | 12.6 | 124 | 9.2 | 0.014 | 6.4 | 9.0 | 3.6 | 0.40 | 265 | 270 |
| 5 | 0.80 | 10.6 | 1.20 | 7.7 | 11.5 | 128 | 9.1 | 0.015 | 7.5 | 9.0 | 2.5 | 0.28 | 2.64 | 270 |
| 6 | 0.53 | 8.5 | 1.02 | 6.1 | 12.8 | 127 | 11.5 | 0.014 | 5.7 | 9.1 | 3.7 | 0.41 | 265 | 269 |
| 7 | 0.50 | 9.0 | 1.01 | 6.0 | 12.5 | 126 | 13.3 | 0.016 | 5.9 | 9.0 | 3.5 | 0.39 | 264 | 269 |
| 8 | 0.63 | 8.5 | 1.03 | 6.0 | 13.4 | 125 | 9.5 | 0.013 | 6.0 | 9.0 | 4.4 | 0.49 | 268 | 271 |
| 9 | 0.62 | 8.5 | 1.02 | 6.5 | 11.0 | 127 | 10.5 | 0.014 | 6.4 | 8.7 | 2.3 | 0.26 | 266 | 269 |
| Comparative Example | | | | | | | | | | | | | | |
| 1 | 0.62 | 8.5 | 1.02 | 7.2 | 12.8 | 125 | 11.6 | *0.030 | 7.0 | 10.5 | 2.3 | 0.22 | *255 | *265 |
| 2 | *0.91 | 10.5 | *1.23 | 8.0 | 12.9 | 127 | *8.8 | *0.032 | 7.8 | 11.0 | 1.9 | 0.17 | *255 | *266 |
| 3 | 0.63 | 10.1 | 1.05 | 7.5 | 12.3 | 126 | 11.9 | *0.025 | 7.3 | 9.0 | 3.3 | 0.37 | *258 | *266 |
| 4 | *0.91 | 9.5 | *1.35 | 5.9 | 12.5 | 124 | *6.5 | *0.021 | 5.5 | 9.0 | 3.5 | 0.39 | *259 | *268 |
| 5 | 0.62 | 8.5 | 1.05 | 6.8 | *9.9 | 123 | 11.0 | 0.016 | 6.3 | 9.0 | 0.9 | *0.10 | 266 | 270 |
| 6 | 0.63 | 8.5 | 1.04 | 5.8 | 15.0 | 118 | 9.2 | 0.013 | 5.6 | 9.0 | 6.0 | *0.67 | 265 | 269 |
| 7 | *0.38 | 7.1 | 1.01 | *4.3 | 13.1 | 119 | 10.3 | 0.017 | *4.2 | 9.0 | 4.1 | 0.45 | 266 | 269 |

| Numbers of Examples and Comparative Examples | Crystallizability: ρ (g/cm³) | $Tm_2$ (–) | X (%) | $D_c$ (Å) | Birefringence Δn (–) | Dynamic Loss Tangent: tan δ (–) | $T_{max}$ (°C.) | Work Loss: ΔE (in 1B) | Coefficient of Stability | Shrinkability under Heat: 175° C. HS (%) | ΔHS/T (%/°C.) | Shrinking Stress under Heat: Peak Temperature (°C.) | Peak Heat Stress (g/d) | 200° C. Heat Stress (g/d) |
|---|---|---|---|---|---|---|---|---|---|---|---|---|---|---|
| Example | | | | | | | | | | | | | | |
| 1 | 1.398 | 376 | 55 | 50 | 0.178 | 0.138 | 128 | 0.009 | 51 | 2.2 | 0.033 | 255 | 0.08 | 0.018 |
| 2 | 1.401 | 377 | 57 | 52 | 0.168 | 0.125 | 120 | 0.008 | 60 | 2.1 | 0.017 | 256 | 0.07 | 0.010 |
| 3 | 1.403 | 379 | 59 | 57 | 0.154 | 0.115 | 115 | 0.007 | 75 | 1.9 | 0.014 | 257 | 0.05 | 0.008 |
| 4 | 1.401 | 378 | 57 | 53 | 0.168 | 0.130 | 120 | 0.008 | 63 | 2.0 | 0.016 | 256 | 0.06 | 0.010 |
| 5 | 1.400 | 378 | 56 | 52 | 0.178 | 0.120 | 130 | 0.009 | 53 | 2.1 | 0.029 | 256 | 0.07 | 0.010 |
| 6 | 1.400 | 377 | 56 | 51 | 0.155 | 0.135 | 110 | 0.008 | 60 | 2.1 | 0.015 | 257 | 0.06 | 0.013 |
| 7 | 1.398 | 376 | 55 | 52 | 0.170 | 0.115 | 125 | 0.006 | 93 | 1.8 | 0.013 | 255 | 0.04 | 0.009 |
| 8 | 1.401 | 380 | 57 | 58 | 0.160 | 0.127 | 114 | 0.008 | 63 | 2.0 | 0.016 | 256 | 0.05 | 0.011 |
| 9 | 1.400 | 377 | 56 | 51 | 0.178 | 0.126 | 116 | 0.008 | 60 | 2.1 | 0.017 | 256 | 0.06 | 0.010 |
| Comparative Example | | | | | | | | | | | | | | |
| 1 | *1.384 | *367 | *43 | *42 | *0.192 | *0.156 | *138 | *0.023 | *8 | *5.5 | *0.053 | *249 | *0.19 | *0.140 |
| 2 | *1.388 | *369 | *46 | *45 | *0.190 | *0.165 | *143 | *0.025 | *7 | *6.0 | *0.092 | *250 | *0.20 | *0.150 |

TABLE 2-continued

| Characteristics of Drawn Yarn | | | | | | | | | | | | | | |
|---|---|---|---|---|---|---|---|---|---|---|---|---|---|---|
| 3 | *1.390 | *369 | *48 | *48 | *0.184 | *0.145 | *135 | *0.018 | *18 | *3.1 | *0.045 | *251 | *0.15 | *0.080 |
| 4 | 1.398 | 375 | 55 | 50 | 0.183 | *0.142 | *133 | *0.020 | *19 | *2.7 | *0.041 | *253 | *0.10 | *0.040 |
| 5 | 1.400 | 378 | 56 | 52 | 0.183 | 0.120 | 125 | 0.008 | 54 | 2.3 | 0.020 | 256 | 0.07 | 0.010 |
| 6 | 1.400 | 377 | 56 | 52 | *0.145 | 0.135 | 118 | 0.008 | 66 | 1.9 | 0.016 | 256 | 0.08 | 0.010 |
| 7 | 1.398 | 377 | 55 | 53 | 0.172 | 0.110 | 125 | 0.007 | 84 | 1.7 | 0.014 | 255 | 0.03 | 0.008 |

Note: the mark * in Table shows items outside range determined by the present invention or shows unsuitable state.

TABLE 3

| Characteristics of Treated Code | | | | | | | | | |
|---|---|---|---|---|---|---|---|---|---|
| Numbers of Examples and Comparative Examples | Strength TS | | Elongation E (%) | Initial Modulus (g/d) | Utilization Ratio of Strength of Raw Yarn to that of Cord (%) | Intermediate Elongation (%) | Shrinkage Factor at 150° C. (%) | Dimensional Stability KE + HS (%) | Utilization Ratio of Strength of Raw Yarn to Strength of Vulcanized Cord (%) |
| | Strength at 20° C. (g/d) | Strength at 200° C. (g/d) | | | | | | | |
| Example | | | | | | | | | |
| 11 | 5.5 | 3.2 | 13.5 | 78 | 85 | 3.5 | 2.0 | 5.5 | 85.0 |
| 12 | 5.3 | 3.0 | 13.4 | 80 | 84 | 3.2 | 1.9 | 5.1 | 84.9 |
| 13 | 5.2 | 2.9 | 13.5 | 78 | 88 | 3.5 | 1.8 | 5.3 | 85.8 |
| 14 | 5.4 | 3.1 | 13.1 | 78 | 84 | 3.5 | 1.9 | 5.4 | 85.7 |
| 15 | 6.3 | 3.4 | 12.2 | 81 | 82 | 3.4 | 2.0 | 5.4 | 86.2 |
| 16 | 5.0 | 2.8 | 13.2 | 80 | 82 | 3.2 | 1.8 | 5.0 | 83.2 |
| 17 | 5.0 | 2.9 | 13.6 | 80 | 83 | 3.4 | 1.6 | 5.0 | 83.5 |
| 18 | 5.3 | 3.0 | 13.6 | 79 | 88 | 3.5 | 1.8 | 5.3 | 89.1 |
| 19 | 5.3 | 3.1 | 13.7 | 80 | 82 | 3.2 | 1.8 | 5.0 | 83.1 |
| Comparative Example | | | | | | | | | |
| 11 | 6.0 | *2.5 | 14.5 | 72 | 83 | 3.5 | *3.5 | *7.0 | 89.1 |
| 12 | 6.0 | *2.7 | 15.1 | 73 | *75 | 3.5 | *3.7 | *7.2 | 89.5 |
| 13 | 5.9 | *2.5 | 14.2 | 75 | *79 | 3.5 | *3.0 | *6.5 | 87.1 |
| 14 | 4.4 | *2.0 | 14.2 | 75 | *74 | 3.7 | *2.8 | *6.5 | 84.7 |
| 15 | *4.7 | *2.5 | 12.5 | 78 | *70 | 3.5 | 2.1 | 5.6 | 85.5 |
| 16 | *4.5 | *2.3 | 14.8 | 73 | *78 | 3.5 | 1.6 | 5.1 | *79.4 |
| 17 | *3.2 | *1.8 | 13.7 | 75 | *77 | 3.3 | 1.8 | 5.1 | 83.0 |

| Numbers of Examples and Comparative Examples | Utilization Ratio of Strength of Raw Yarn to Strength of Cord Subjected to Fatigue Test (%) | Exotherm Temperature of Tube (°C.) |
|---|---|---|
| Example | | |
| 11 | 75 | 75 |
| 12 | 72 | 70 |
| 13 | 73 | 63 |
| 14 | 71 | 68 |
| 15 | 79 | 74 |
| 16 | 76 | 70 |
| 17 | 74 | 54 |
| 18 | 74 | 69 |
| 19 | 72 | 70 |
| Comparative Example | | |
| 11 | *62 | *105 |
| 12 | *63 | *107 |
| 13 | *67 | *98 |
| 14 | *65 | *95 |
| 15 | *67 | 72 |
| 16 | 75 | 67 |
| 17 | 73 | 51 |

Note: the mark * in Table shows items outside range determined by the present invention or shows unsuitable state.

We claim:

1. A polyester fiber comprising ethylene terephthalate as main recurrent units and having the following characteristics:

(a) an intrinsic viscosity $\eta$ of between 0.50 and 0.80;

(b) a tan $\delta$ of 0.10 to 0.138 and a $T_{max}$ of 110° C. to 130° C., wherein tan $\delta$ is the peak value of a dynamic loss tangent and $T_{max}$ the peak temperature in ° C.;

(c) a value of $E_2/E_1$ of 0.49 or less, wherein $E_1$ is the elongation in % from zero to a secondary yield point and $E_2$ the elongation in % from the secondary yield point to a breaking point;

(d) a coefficient of stability, expressed as the reciprocal of the product of work loss $\Delta E$ in inch.lb at 150° C. multiplied by the shrinkage factor HS in % under a dry heat at 175° C., of 50 $inch^{-1}.lb^{-1}.\%^{-1}$ or more;

(e) a value of $TS/\eta$ of 9.0 or more, wherein TS in g/d is the strength of the fiber, and $\eta$ is the intrinsic viscosity of the fiber;

(f) a $Tm_1$ of 260° C. or more, wherein $Tm_1$ is the melt starting temperature in ° C.; and (g) a birefringence $\Delta n$ of 0.150 to 0.180.

2. A polyester fiber according to claim 1, wherein the cross ratio $C_d$ of a single filament is 1.20 or less, $C_d$ being the ratio of the mean maximum diameter of a single filament to the mean minimum diameter of a single filament.

3. A polyester fiber according to claim 1, wherein the work loss $\Delta E$ at 150° C. is 0.015 in inch.lb or less.

4. A polyester fiber according to claim 1, wherein the product of $Tm_2$ multiplied by $\rho$ is 370 in ° C. $g/cm^3$ or more, $Tm_2$ being the crystalline melting point in ° C. and $\rho$ the density in $g/cm^3$ at 25° C.

5. A polyester fiber according to claim 4, wherein $Tm_2$ is 268° C. or more.

6. A polyester fiber according to claim 1, wherein HS is 2.5% or less and $\Delta HS/\Delta T$ is 0.040 in %/° C. or less, $\Delta HS/\Delta T$ being the change of a temperature dependency of the shrinkage factor HS under dry heat per° C.

7. A polyester fiber according to claim 1, wherein $\Delta TS/\Delta T$ is 0.02 in g/d° C. or less, $\Delta TS/\Delta T$ being the change of a breaking strength per ° C.

8. A polyester fiber according to claim 1, wherein the peak value of a shrinking stress under heat in a curve showing a relationship between a temperature and a shrinking stress under heat, is 0.10 g/d or less, a peak temperature thereof is 255° C. or more, and the stress under heat is kept at 0.018 g/d or less when the temperature is 200° C.

9. A polyester fiber according to claim 1, wherein size $D_c$ of a crystal is 50 angstrom or more.

10. A polyester fiber according to claim 1, wherein elongation $E_1$ is 13% or less and crystallinity X obtained from a density at 25° C. is 55% or more.

* * * * *